United States Patent [19]

Vaughn

[11] 4,223,491

[45] Sep. 23, 1980

[54] GUY WIRE GUARD

[76] Inventor: Wilbur C. Vaughn, P.O. Box 422, 337 Market St., Berwick, Pa. 18603

[21] Appl. No.: 949,151

[22] Filed: Oct. 6, 1978

[51] Int. Cl.[2] ..... E04H 12/20; H01B 17/58

[52] U.S. Cl. ..... 52/147; 174/136

[58] Field of Search ..... 52/146, 147, 731; 174/136

[56] References Cited

U.S. PATENT DOCUMENTS

| | | | |
|---|---|---|---|
| 1,485,994 | 3/1924 | Salisbury | 174/136 |
| 1,630,356 | 5/1927 | Perks | 52/147 |
| 1,645,748 | 10/1927 | Gammeter | 174/136 |
| 1,765,823 | 6/1930 | Burke | 52/147 |
| 1,995,503 | 3/1935 | Elliott | 52/147 |
| 2,880,828 | 4/1959 | Skubal | 52/147 |
| 3,057,443 | 10/1962 | Schlein | 52/147 |
| 3,173,519 | 3/1965 | Sullivan | 52/147 |
| 3,251,161 | 5/1966 | Stirn | 174/136 |
| 3,425,456 | 2/1969 | Schibig | 174/136 |
| 3,900,697 | 8/1975 | Yotsugi | 174/136 |

FOREIGN PATENT DOCUMENTS 24391 of 1911 United Kingdom ..... 52/731

OTHER PUBLICATIONS

Re. 19,639 of Jul. 9, 1935 of the Original U.S. Patent 1,933,818 of Patentee Miller.

*Primary Examiner*—James L. Ridgill, Jr.
*Attorney, Agent, or Firm*—Albert C. Johnston

[57] ABSTRACT

A guard for protective use over a guy wire of a utility pole or the like is provided as a long tubular body of weather and impact resistant plastic material formed with oppositely disposed longitudinal edge portions that protrude and converge laterally along a slit through which a guy wire can enter the body. The body is secured on the wire by bolts which pass transversely through holes in the body between the wire and the slit and hold the edge portions pressed together. The guard will cushion impacts, and it is difficult to vandalize.

5 Claims, 9 Drawing Figures

GUY WIRE GUARD

This invention relates to a guard for protective use over guy wires of utility poles, trees and similar tall ground supported structures.

Guards are commonly used on guy wires of utility poles located near walkways, yards and streets where there is danger of injury to persons or vehicles from collision with a bare guy wire. The guard enhances the visibility of the guy wire and in some cases may prevent or reduce injury from impacts with it.

Among numerous proposals for the construction or improvement of guy wire guards are those disclosed in U.S. Pat. Nos. 1,630,356; 1,765,823; 1,995,503; Re 19,639; 2,880,828; 3,057,443 and 3,173,519.

In a typical situation of a utility pole, a guy wire extends from a connection high up on the pole down to a ground anchor that includes a rod having an eye through which the guy wire is looped and then clamped back on itself with suitable clamps.

A guard for such a guy wire desirably covers the wire from a level about eight feet or more above the ground down to a level where the loop on the eye of the anchor rod is also covered.

The principal object of the present invention is to provide a guy wire guard that is particularly economical to manufacture, can be installed in a simple manner, and when installed is difficult to dislodge or otherwise vandalize and will not only give the desired visibility to the guy wire but also reduce the hazard of injury to a person or a vehicle colliding with it.

It has been found that these and other advantages can be achieved by providing and utilizing as a guy wire guard an elongate tubular body of weather and impact resistant plastic material, such for example as a suitably colored high density polyethylene, having the form of a long resilient sheet of such material bent about a longitudinal axis to enclose a space for containing a guy wire and attachments thereof and having oppositely disposed longitudinal edge portions that protrude in a direction away from that axis, i.e., laterally, to define a slit along the body between opposing inner surfaces of these edge portions, which slit is elastically expansible for admitting a guy wire into the body space, together with means for contracting opposite wall portions of the body in a direction transverse to the slit so as to press the edge portions together and hold the tubular body securely in place upon the guy wire.

In a preferred embodiment of the invention, the tubular body has a cross-sectional shape resembling a tear drop, and it is formed by extruding the required plastic material into a long hollow body having this shape and then cutting the extrusion into lengths, typically of about eight feet each, desired for the guy wire guard. The extrusion preferably is an unslitted hollow body having a tear drop shape, which, after being extruded, is sliced open along an axial plane at the center line of the laterally protruding portion to form the longitudinal edge portions bordering the slit.

The means for contracting opposite wall portions of the tubular body and holding the body in place on a guy wire comprise sets of bolt holes which are formed in the opposite wall portions of the body at locations to receive bolts which extend across the body space between the slit and a guy wire or attachment thereof enclosed in that space. Sets of such bolt holes preferably are formed in lower, middle and upper regions of the tube, and the lower region preferably is provided with a plurality of sets of bolt holes suitably spaced apart along its axis, for instance at spacings of about six inches, so that one of these sets will always be available for passing a bolt through the anchoring loop of a guy wire enclosed in the guard.

With a wire guard in accordance with the invention, local separations of the mating edge portions can be tolerated so that the guard can extend over and substantially cover relatively wide anchoring attachments of the guy wire, such as its looped end engaged with the eye of a ground anchor rod. Thus, the guard is useful for a variety of guy wires and attachments thereof.

The above-mentioned and other features and advantages of the invention will be further evident from the following description and the accompanying drawing of illustrative embodiments thereof. In the drawing.

Figures 1, 2, 3, 4, 5, 6, 7, 8, 9:
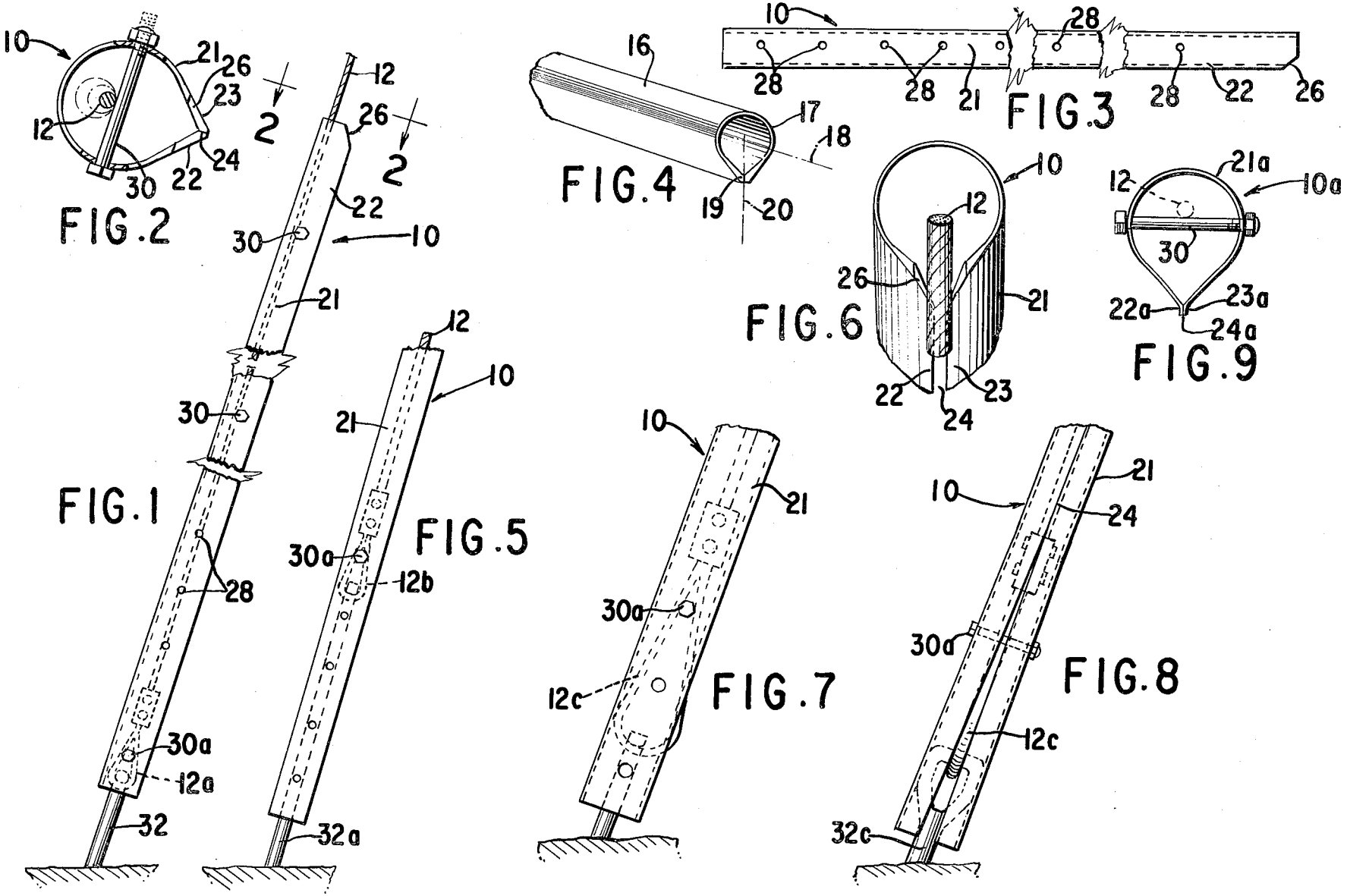
FIG. 1 is a schematic elevational view, partly broken away, of a guy wire guard made according to the invention, as installed over a guy wire and its ground anchor.
FIG. 2 is an enlarged end view of the guy wire guard, taken in section through the guy wire along the line 2—2 of FIG. 1.
FIG. 3 is a side view of the guy wire guard, partly broken away.
FIG. 4 is a perspective view of a portion of an extruded tubular body from which the guy wire guard is formed.
FIG. 5 is a side elevational view of a lower portion of the guard in place over a guy wire and ground anchor.
FIG. 6 is a perspective view of a top end portion of the guy wire guard as it is positioned for installation of the guard.
FIG. 7 is a schematic side elevational view of a lower end portion of the guard installed over a guy wire and ground anchor.
FIG. 8 is a view similar to that of FIG. 7 but with the guy wire and guard turned 90° away from their position shown in FIG. 7.
FIG. 9 is an end view of another form of the guy wire guard assembled with a bolt for installation.

Referring to the drawing, FIG. 1 shows a guy wire guard 10 made according to the invention and installed as a protective cover enclosing the lower reach of a guy wire 12 down to the eye of a ground anchor rod 14.

The guy wire guard 10 is formed from a tubular extrusion 16 of a suitably weather and impact resistant pigmented plastic material, such as a pigmented high density polyethylene. The material preferably is colored yellow by a pigment that resists sunlight, and contains a suitable substance to retard deterioration of it by ultraviolet light. The extrusion as illustrated in FIG. 2 has a cross-sectional shape resembling that of a tear drop. The wall 17 of the extrusion thus protrudes laterally and converges in a direction away from its longitudinal axis 18, forming a thickened apex portion 19 along one side of the extrusion. This thickened portion is cut through by slicing it along a central plane 20 radial to the axis 18, thus forming, as illustrated in FIG. 2, a slitted long tubular body 21 having laterally protruding edge portions 22 and 23 which present confronting inner surfaces along a longitudinal slit 24 at one side of the body.

In the embodiment of FIGS. 1–8, the edge portions 22 and 23 are formed with increasing thickness in the direction toward the slit 24 so that their confronting inner surfaces which border the slit have greater width than would be available from the wall thickness suitable for other portions of the tubular body 21. The confronting inner surfaces can be pressed together with considerable force when the guard is installed over a guy wire, without causing either of the edge portions to spread inside or outside the other in a way which would distort the shape of the guard or cause it to become loose on the guy wire.

The tubular body 21 is cut from the extrusion 16 to a length desired for covering the lower reach of the guy wire 10. This length, for instance, amounts usually to about eight (8) feet. Then at one end of the body, which ordinarily is its upper end, corner parts of the edge portions 22 and 23 are cut away to form a substantially V-shaped notch 26 the opening of which is wider than the guy wire 12 and the apex of which leads into the slit 24. (See FIG. 6).

The tubular body 21 is also provided with means for contracting opposite portions of its wall in a direction transverse to the slit 24 so as to press the confronting surfaces of the edge portions 22 and 23 together along the slit and hold the body securely installed on the guy wire. For this purpose, sets of bolt holes 28 are formed in diametrically opposite portions of the wall of the tubular body at several locations spaced apart along its length, and fitting bolts 30 are provided to pass through at least some of the sets of bolt holes 28 so that these bolts will bridge the space inside the tubular body and lie between the slit 24 and a guy wire in that space. The bolt holes 28, for instance, are drilled holes of $\frac{3}{8}$ inch in diameter. Preferably one set of them is provided in an upper region of the tubular body at a location about one foot from its top end, another set is provided in a middle region of the body, and several sets are provided along the lower region of the body at locations, for instance, about six inches apart. Thus, at least one of the lower sets of bolt holes will be available for passing a lower bolt 30*a*through the looped end of a guy wire engaged with a ground anchor rod 32 even though this looped end may be at any of various locations relative to the lower end of the guard as indicated at 12*a*, 12*b* and 12*c* in FIGS. 1, 5 and 7, respectively.

The installation of the guard 10 on a guy wire can be effected quickly and in a simple manner. The tubular body 21 is placed against a guy wire 12 with the end notch 26 straddling the wire as indicated in FIG. 6. The tubular body then is pushed against the guy wire 12, causing the edge portions 22 and 23 to be spread apart by a wedging effect with entry of the guy wire into the space inside the tubular body. Then the body 21 is slid to a desired position over the looped lower end of the guy wire, and three bolts 30 are fixed in place. One of the bolts is passed through the bolt holes in the upper region of body 21, to lie between the wire 12 and the slit 24; another bolt is passed similarly through the bolt holes in the middle region of the body; and a third bolt is passed through a set of bolt holes in the lower region of the body at a location where this bolt 30*a* will extend through the anchoring loop 12*a*, 12*b* or 12*c* at the lower end of the guy wire. The fastening nuts of the bolts so placed are then tightened sufficiently to press the nearby edge portions 22 and 23 of the tubular body firmly together along the slit 24, and the nuts if desired may be locked to prevent removal. The guard 10 can be installed on a guy wire having an anchoring loop 12*c* wider than the space inside the tubular body 21, as indicated in FIGS. 7 and 8. In such a case, a portion of the wide loop 12*c* will protrude through the slit 24, the adjacent edge portions 22 and 23 being sufficiently flexible to be bulged apart by the wire loop, and the lowermost bolt 30*a* is passed through a set of bolt holes registering with an upper portion of the loop 12*c* to hold the slit 24 closed above this loop.

A modified form 10*a* of the guy wire guard is shown in FIG. 9. In this embodiment, the tubular body 21*a* is formed with a wall of substantially uniform thickness, which again, substantially as in the embodiment of FIGS. 1 and 2, has the form of a long resilient sheet of the described plastic material bent about a longitudinal axis to enclose a space of containing a guy wire and having oppositely disposed longitudinal edge portions 22*a* and 23 *a* that protrude and converge in a direction away from the axis to define a slit 24 along the body between opposing inner surfaces of these edge portions. The body 21*a* may be formed by extrusion or by deforming a preformed sheet of the plastic material, and may then be provided with bolt holes 28 and with a notch 26 at one end substantially as in the case of the FIG. 1 embodiment. The guard 10*a* is installed on a guy wire 12 in substantially the same manner of the guard 10. A bolt 30 holding it in place over the guy wire will draw opposite wall portions of the body 21*a* toward each other and press the nearby edge portions 22*a* and 23*a* together along the slit 24*a* so that the area of contact between these edge portions increases as the bolt length is reduced.

It will be evident to persons skilled in the art that the present invention may be carried out in various ways other than those hereinabove described or illustrated in the drawing without departing from the substance of the invention, which is intended to be defined by the appended claims.

What is claimed is:

1. A guard for a guy wire or the like, comprising an elongate tubular body of weather and impact resistant plastic material having the form of a long resilient sheet of such material bent about an axis longitudinal thereof to enclose a space for containing a guy wire and having oppositely disposed confronting longitudinal edge portions that protrude in a direction away from said axis to define a substantially radially disposed slit along said body between opposing inner surfaces of said edge portions, said body having in cross-section substantially a tear drop shape, said edge portions being spreadable apart elastically by a pushing of said body against a guy wire between said edge portions, to admit a guy wire into said space, and means comprising sets of holes in opposite wall portions of said body at locations to receive bolts extending across said space between said slit and a guy wire in said space for contracting said opposite wall portions in a direction transverse to said slit to press said edge portions together and hold said body secure upon the guy wire.

2. A guy wire according to claim 1, said body being a length of an extrusion of high density polyethylene.

3. A guy wire guard according to claim 1, said body having along a lower region thereof a plurality of sets of said bolt holes spaced apart at locations to receive between the holes of at least one set a bolt passed through an anchoring loop of the guy wire, said body also having at least one set of said bolt holes in a middle region thereof, and in an upper region thereof, said edge portions along said lower region being spreadable apart elastically by a said loop in use of the guard on a guy wire having an anchoring loop wider than said space.

4. A guy wire guard according to claim 1, said body edge portions being of greater thickness than the thickness of other portions of said body.

5. A guy wire guard according to claim 4, the wall thickness of said body increasing toward said inner surfaces.

* * * * *